US011350736B2

(12) United States Patent
Smith

(10) Patent No.: US 11,350,736 B2
(45) Date of Patent: Jun. 7, 2022

(54) DESK IN THE SHAPE OF A BLOCK CHARACTER

(71) Applicant: Ruby Thompson Smith, Columbia, SC (US)

(72) Inventor: Ruby Thompson Smith, Columbia, SC (US)

( * ) Notice: Subject to any disclaimer, the term of this patent is extended or adjusted under 35 U.S.C. 154(b) by 82 days.

(21) Appl. No.: 16/436,124

(22) Filed: Jun. 10, 2019

(65) Prior Publication Data

US 2019/0374022 A1 Dec. 12, 2019

Related U.S. Application Data

(60) Provisional application No. 62/683,342, filed on Jun. 11, 2018.

(51) Int. Cl.

| | |
|---|---|
| ***A47B 7/00*** | (2006.01) |
| ***A47B 13/06*** | (2006.01) |
| ***A47B 13/04*** | (2006.01) |

(52) U.S. Cl.

CPC ..... *A47B 7/00* (2013.01); *A47B 13/04* (2013.01); *A47B 13/06* (2013.01)

(58) Field of Classification Search

CPC ..... A47B 7/00; A47B 13/04; A47B 13/06; A47B 41/00; A47B 21/00; A47B 83/001; A47B 39/00

USPC ..... 108/42

See application file for complete search history.

(56) References Cited

U.S. PATENT DOCUMENTS

| | | | | |
|---|---|---|---|---|
| 1,430,465 | A * | 9/1922 | Niemuth | A47B 39/00 297/174 R |
| 1,479,766 | A * | 1/1924 | Whyman | A47B 41/00 312/230 |
| 2,269,834 | A * | 1/1942 | Wagner | A63G 13/06 182/33.2 |
| 3,603,656 | A * | 9/1971 | Ferman | A47C 4/021 312/195 |
| 4,312,086 | A * | 1/1982 | Bianco | A47B 83/00 108/108 |
| D302,362 | S * | 7/1989 | Armstrong | D25/16 |
| 4,914,873 | A | 4/1990 | Newhouse | |
| D312,927 | S | 12/1990 | Martin et al. | |
| D320,322 | S * | 10/1991 | Hendrix | D6/674.1 |
| D322,183 | S | 12/1991 | Martin et al. | |
| 5,474,373 | A * | 12/1995 | Forester | A47B 21/00 312/196 |
| 5,547,270 | A * | 8/1996 | Dang | A47B 85/08 312/194 |
| D405,981 | S | 2/1999 | Alexander et al. | |
| 6,460,470 | B1 | 10/2002 | Scharer et al. | |
| 6,568,001 | B2 * | 5/2003 | Walsh | A47C 19/207 5/2.1 |
| 6,676,231 | B1 | 1/2004 | Kelley et al. | |
| D603,185 | S | 11/2009 | Bockheim et al. | |
| 7,958,683 | B2 | 6/2011 | Abusada et al. | |
| 8,505,133 | B1 * | 8/2013 | Pollard, Sr. | A47C 19/22 5/2.1 |

(Continued)

FOREIGN PATENT DOCUMENTS

CN 1969714 A 5/2007

*Primary Examiner* — Daniel J Troy
*Assistant Examiner* — Timothy M Ayres
(74) *Attorney, Agent, or Firm* — Ballard Spahr LLP

(57) ABSTRACT

A desk and desk system are disclosed. The desk forms a three-dimensional shape of an alphabet letter, number, or typographical symbol.

19 Claims, 2 Drawing Sheets

(56) References Cited

U.S. PATENT DOCUMENTS

| | | | | |
|---|---|---|---|---|
| 9,185,974 | B2 * | 11/2015 | Martin | A47B 13/081 |
| 10,758,803 | B2 * | 9/2020 | Morse | A63B 69/0048 |
| 10,842,261 | B1 * | 11/2020 | Gonzalez | A47B 5/04 |
| 2005/0189851 | A1 | 9/2005 | Martin et al. | |
| 2010/0269254 | A1 * | 10/2010 | Sanders, Jr. | A47C 19/20 5/2.1 |
| 2018/0368572 | A1 * | 12/2018 | Amit | F21V 23/045 |
| 2020/0222778 | A1 * | 7/2020 | Smith | A63B 71/023 |

* cited by examiner

DESK IN THE SHAPE OF A BLOCK CHARACTER

CROSS-REFERENCE TO RELATED APPLICATION

This application claims priority to, and the benefit of the filing of U.S. Provisional Application No. 62/683,342, filed Jun. 11, 2018, which is incorporated by reference herein in its entirety.

FIELD OF INVENTION

This disclosure relates to a desk and, more particularly, to a desk in the shape of a three-dimensional block character, such as a letter.

BACKGROUND

Desks can be used in a wide variety of environments and by users of varying gender, age, and other characteristics. A need exists for a desk that provides additional benefits to users of such varying characteristics, for example, by providing aspects that enable the users to integrate interactive play with work.

SUMMARY

Described herein are apparatuses and systems of a desk. In a first aspect, the desk comprises a body having a generally planar front panel defining a front surface that extends in a vertical dimension and a first horizontal dimension, a generally planar back panel, and at least one transverse surface panel extending transversely between, and attached to, the front panel and the back panel along a transverse dimension that is perpendicular to the front surface. The front panel, in cross section in a plane parallel to the front surface, can define an outline of at least a portion of a block character. The front panel, the back panel, and the at least one transverse surface panel can cooperate to define a three-dimensional projection of the outline of said at least a portion of the block character. The block character can be selected from the group consisting of: an alphabet letter, a number, and typographical symbol. A generally planar work surface panel can be attached to the body.

In a second aspect, the desk comprises a body comprising a generally planar front panel defining an inner surface and an outer surface, a generally planar back panel, defining an inner surface and an outer surface, that is generally parallel to the planar front panel and spaced from the planar front panel in a first dimension so that the inner surface of the front panel opposes the inner surface of the back panel, and a connecting panel extending transversely between, and attached to, the front panel and the back panel. The front panel, in cross section in a plane perpendicular to the first dimension, defines an outline of at least a portion of a block character (optionally, the entire block character). The block character is selected from the group consisting of: an alphabet letter, a number, and typographical symbol. A generally planar work surface panel is attached to the body.

According to a third aspect, desk comprises a body having a generally planar front panel defining a front surface, a generally planar back panel, at least one transverse surface panel extending transversely between, and attached to, the front panel and the back panel, and a generally planar work surface panel attached to the body. The front panel and the work surface panel, in cross section in a plane parallel to the front surface, can cooperate to define an outline of at least a portion of a block character. The front panel, the back panel, the at least one transverse surface panel, and the work surface panel can cooperate to define a three-dimensional projection of the outline of said at least a portion of the block character. The block character can be selected from the group consisting of: an alphabet letter, a number, and typographical symbol.

According to a fourth aspect, a system includes a plurality of desks, each desk comprising a body having a generally planar front surface, a generally planar back surface, and at least one transverse surface panel extending transversely between the front surface and the back surface. The front surface can define an outline of at least a portion of a block character. The front surface, the back surface, and the at least one transverse surface can cooperate to define a three-dimensional projection of the outline of said at least a portion of the block character. The block character can be selected from the group consisting of: an alphabet letter, a number, and typographical symbol. A generally planar work surface panel can be attached to the body.

Additional advantages of the invention will be set forth in part in the description which follows, and in part, will be obvious from the description or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF FIGURES

These and other features of the preferred embodiments of the invention will become more apparent in the detailed description in which reference is made to the appended drawings wherein.

DETAILED DESCRIPTION

Figure 1:
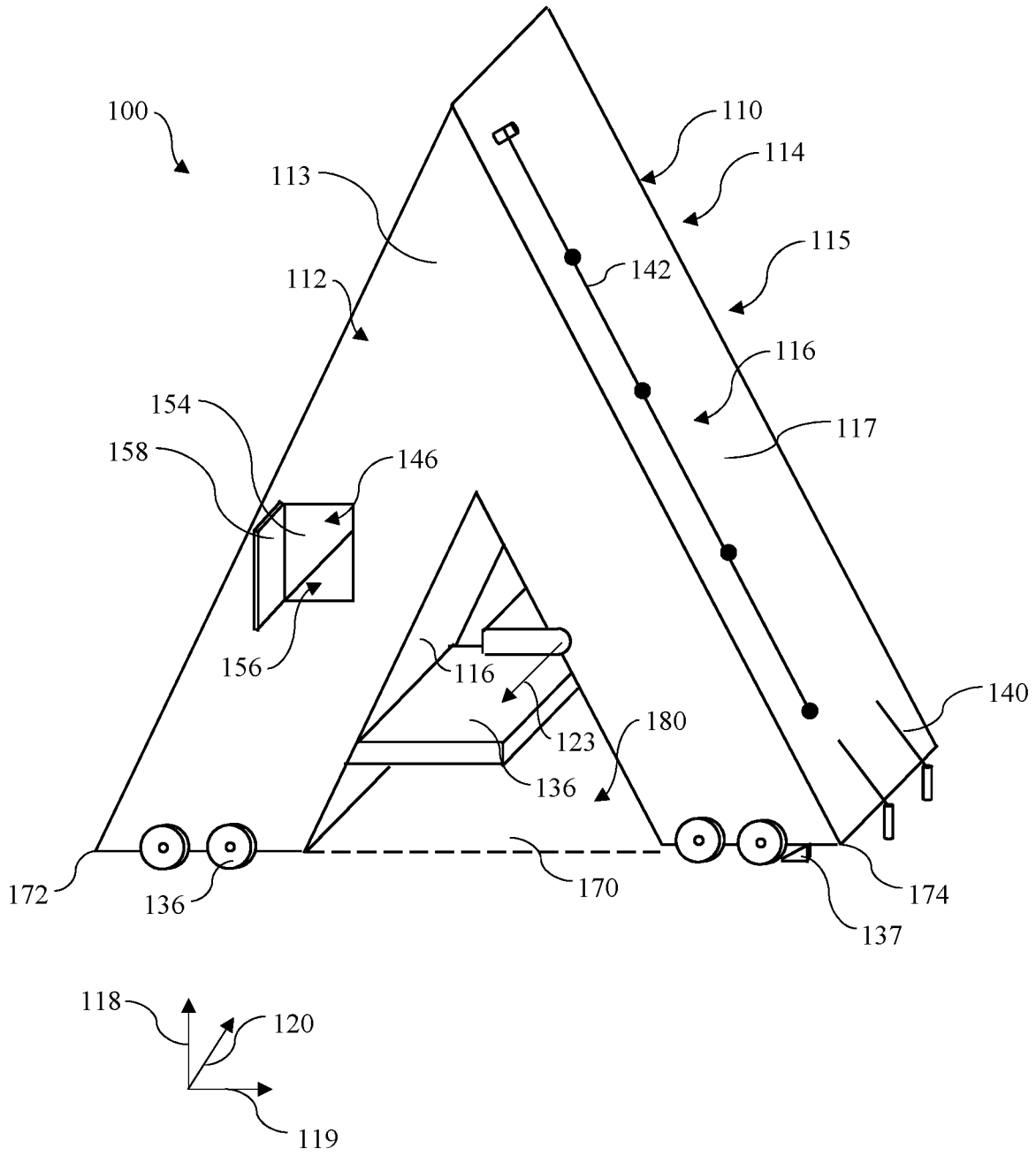
FIG. 1 is a perspective view of a desk of one embodiment.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified as such can, of course, vary. It is also to be understood that the terminology used herein is for the purpose of describing particular aspects only and is not intended to be limiting.

The following description is provided as an enabling teaching of the disclosed articles, systems, and methods in their best, currently known embodiments. To this end, those skilled in the relevant art will recognize and appreciate that many changes can be made to the various aspects of the articles, systems, and methods described herein, while still obtaining the beneficial results of the disclosure. It will also be apparent that some of the desired benefits of the present disclosure can be obtained by selecting some of the features of the present disclosure without utilizing other features or combining some features of one embodiment with features of another embodiment. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "a surface" can include two or more such surfaces unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

Optionally, in some aspects, when values are approximated by use of the antecedent "substantially" or "generally," it is contemplated that values within up to 15%, up to 10%, or up to 5% (above or below) of the particularly stated value can be included within the scope of those aspects. Further, it is contemplated that "substantially parallel" and "generally parallel" surfaces should include surfaces that vary by no more than 20 degrees, or 15 degrees, 10 degrees, or 5 degrees with respect to each other.

As used herein, the terms "optional" or "optionally" mean that the subsequently described event or circumstance may or may not occur, and that the description includes instances where said event or circumstance occurs and instances where it does not.

The word "or" as used herein means any one panel of a particular list and also includes any combination of panels of that list.

As used herein, the term "block character shaped body" should be understood to mean a body in which the peripheral surfaces cooperate to define a generally consistent cross-sectional profile (corresponding to at least a portion of a block character) at any plane that is parallel to the body's front surface and positioned along a transversely extending depth dimension between the body's front surface and the body's rear surface.

Similarly, a three-dimensional projection of an outline should be understood to mean a body having consistent cross sections of the outline in planes perpendicular to the projection's direction from the body's front surface to the body's back surface.

Described herein with reference to FIG. 1, a desk 100 comprises a body 110. The body can comprise a planar or generally planar front panel 112, a planar or generally planar back panel 114, and one or more transversely extending surface panels 116. The planar or generally planar front panel 112 defines a front surface 113, and the back panel defines a back surface 115. Each of the transversely extending surface panels 116 define respective transverse surfaces 117. The one or more transversely extending surface panels 116 can extend between, and attach to, the front panel 112 and the back panel 114. It is contemplated that the transversely extending surface panels 116 may have a planar or generally planar profile, as in FIG. 1, or a curved profile.

As shown in FIG. 1, the front panel 112, the back panel 114, and the transversely extending surface panels 116 connect such that the body 110 forms a three dimensional shape of at least a portion of a character (optionally, the entire character). That is, the front surface can define an outline of at least a portion of a block character (optionally, the entire character) in a plane defined by a vertical dimension 118 and a width dimension 119, and the front surface 113, the back surface 115, and the transverse surfaces 117 can cooperate to define at least a portion of the block character (optionally, the entire character) having consistent cross sections in planes perpendicular to the front surface 113 spaced along a depth dimension 120. Accordingly, the front panel 112, in cross section in a plane parallel to its front surface 113, defines an outline of at least a portion of a block character (optionally, the entire character). It should be understood that a block character includes a character shape having an area outlined by peripheral edges, wherein the area defines the cross-sectional profile of the character. The spacing between opposing peripheral edges (e.g., the spacing between inner and outer transversely extending surfaces) can have a select thickness. The select thickness, in some embodiments, can be at least six inches or at least twelve inches. According to various embodiments, the three dimensional shape can be an alphabet letter, a number, or any typographical symbol (or combinations or portions thereof). It is further contemplated that the alphabet letter, number, or typographical symbol are not limited to any particular typeface (e.g., Arial, Times New Roman, Calibri, etc.). The shape of the desk can be distinct so that a viewer can recognize that the desk is in the form of the character.

It should be understood that the term "panel" can comprise one or more sub-panels that attach to each other to cooperatively define a panel. For example, the panel 112 can include two sub-panels.

The body 110 further comprises a planar or generally planar work surface panel 122 that attaches to the body 110. As shown in FIG. 1, the work surface panel 122 can attach in a cantilevered fashion from a transversely extending surface panel, such as, for example, an inner transversely extending surface panel 116. In a further aspect, the work surface panel 122 can be configured to pivot around a pivotal axis 123 or otherwise hingedly attach to the body 110. In this way, the work surface panel 122 may be configured to be selectively adjustable to a desired angle of orientation. It is contemplated that the planar or generally planar work surface panel 122 may function as a writing surface of the desk 100. Accordingly, the planar or generally planar work surface panel 122 can be sized and rigidly supported to enable a user to write/draw/color thereon, and otherwise be configured to function as a work surface. For example, the work surface panel, when pivoted to a use position, can be parallel or substantially parallel to a horizontal surface, such as a floor. The work surface panel can be spaced with respect to the body so that a user has sufficient elbow room, has sufficient head room thereabove, and can be seated comfortably spaced from the work surface panel 122.

The body 110 has a footprint 170 (shown in part and outlined by a dashed line) defined as a rectangular area beneath the desk body between the front panel and the back panel from a first side extremity 172 to a second side extremity 174 of the front panel 112. The first and second side extremities 172, 174 are defined as the points farthest from each other on the front panel 112 in the width dimension 119. The planar or generally planar work surface panel 122 can be disposed within the footprint 170. I.e., a vertical projection of the planar or generally planar work surface panel 122 onto the footprint 170 can be within the footprint 170. In some embodiments, portions of the body 110 can be disposed vertically above the work surface panel. In further embodiments, the body 110 can cover an entire area directly above the work surface panel 122 and a seat 138. That is, the body 110 can partially or entirely define a covered volume 180, as shown, for example, in FIG. 1. The work surface panel 122 and the seat 138 can be inside the covered volume 180. Accordingly, a portion of the body 110 can overlie the work surface panel 122 and the seat 138. In further embodiments, an inner transversely extending surface 117 can define a lower surface 182 below the covered volume 180. In further embodiments, the planar or generally planar work surface 122 can extend from a side of the body and extend in the width dimension 119 beyond the footprint 170. In yet further embodiments, the planar or generally planar work surface panel 122 can extend from the front surface 115 in the depth dimension 120. In some embodiments, the work surface panel 122 can define a portion of the three dimensional block character so that the body 110 and the work surface panel 122 cooperate to define the three dimensional block character.

The work surface panel 122 can be configured to be stowed within the body 110. For example, the body 110 can define a slot. The work surface panel 122 can be slidably stowed within the slot of the body 110. In some embodiments, the work surface 122 can slide in the slot along tracks. The work surface panel 122 can be raised above an upper lip so that it can then be pivoted, via a hinge, about its axis 123. The work surface panel 122 can be pivoted so that it is horizontal and rests against, and is supported by, the upper lip of the body.

The body 110 may be configured such that it may be used by both children and adults in the indoor and outdoor environment. To provide safe use, particularly to support use by both multiple children and adults, the body 110 may be formed of a structurally rigid material. The material can be of a sufficient thickness to support a weight of a user. It is further contemplated that the material used to build the body 110 may comprise flexible components at certain high stress areas of the body 110. For example, connection areas between respective panels may comprise a material with increased flexibility properties, such as, for example, a durable silicone or rubber. It is further contemplated that one or more fasteners/couplings used to connect the panels may allow for flexure and still maintain overall structural integrity.

In another aspect, the body 110 may be hollow or substantially hollow or otherwise define a void space. It is further contemplated that the hollow structure of the body 110 may be filled with a filler material that increases the structural rigidity of the body 110. In an aspect, the filler material may be amorphous in the manner that it fills an internal cavity of the body. In an alternative, the filler material may be arranged in a structural orientation, such as a honeycomb orientation, as illustrated, to provide additional structural integrity. In an aspect, the body 110 may comprise a virgin or recycled material selected from polymer, metal, cellulosic material and/or combinations thereof. Optionally, the structurally rigid material may comprise a high density polyethylene, fiberglass reinforced plastic, wood, or wood composite or any kind combination thereof.

The body 110 may also comprise at least a portion that is collapsible. The collapsible portion allows a user additional flexibility in using the body 110. For example, the collapsible aspect of the body may allow for easier transport or reduction in storage space. The body 110 may be collapsible about an axis via a hinge that couples respective first and second body sections of the body 110 placed on a surface of the body. It is further contemplated that the hinge may be actuated to allow the first body section to fold with respect to the second body section. The body may further comprise a latch that prevents the hinged body portions from moving with respect to each other. The latch may be configured to engage when the body 110 is in use. Further, the latch may be disengaged when a user seeks to collapse the body 110. In another aspect, the first body section may be detachable from the second body section. It is contemplated that the hinged connection disclosed above can be provided at any connection between adjacent body sections as described and depicted herein.

Figure 2:
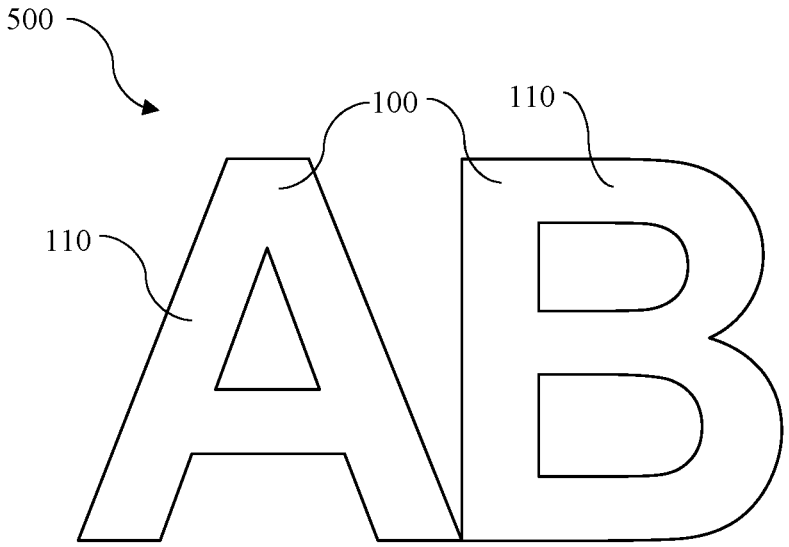
FIG. 2 is a schematic diagram of system comprising a plurality of desks as disclosed herein.

The body 110 can take the form of an alphabet letter, number, or typographical symbol. The alphabet letter may be an uppercase or a lowercase letter. Referring also to FIG. 2, it is also further contemplated that multiple bodies 110 may be coupled together as a system 500. The system 500 may comprise a plurality of bodies to produce a plurality of alphabet letters, numbers, or typographical symbols. Alternatively, it is contemplated that a plurality of bodies can cooperate to define a single alphabet letter, number, or typographical symbol. It is further contemplated that the system may comprise the box-type body shown in FIG. 1. For example, a name or phrase may be represented by the system of desks, (e.g., "John", "ABC", "1, 2, 3"). It is further contemplated that examples of alternative configurations of letters may be used as an individual body or be integrated in the system of desks. In certain aspects, the body 110 can define a work surface. That is, the work surface panel 122 can be a transversely extending surface panel 116, or a portion thereof. In further embodiments, the body 110 can define the seat 138.

In certain aspects, the body 110 further comprises at least one mobility device. The mobility device 136 may be at least one fixture that is permanently affixed or releasably affixed to at least one surface of the body 110. This fixture may reduce the friction between the body and the ground that it rests upon. Suitable examples of the mobility device 136 include, but are not limited to, a wheel, swivel, chair castor, roller, skid, and the like, or any combination thereof. It is also further contemplated that the mobility device 136 may be configured for selective detachment from the body 110. A user may attach the mobility device 136 to a surface of the body 110, when the user desires to move or reposition the desk. In another aspect, mobility device 136 may include an immobilization component 137. The immobilization component 137 may be configured to hold the mobility device 136 in a stationary position, especially when the mobility device is not removed. Suitable examples of immobilization component 137 include, but are not limited to, a wheel lock, wheel chock, and the like, or combinations thereof.

The body 110 may further comprise at least one seat 138. The seat 138 may be attached to the body 110 on at least one surface. As shown in FIG. 1, the seat may be connected to an inner transversely extending surface panel 116. The seat 138 is configured to provide a user at least one place to rest as the user is interacting with the desk 100. Accordingly, the seat 138 is disposed proximate the desk so that the user can comfortably sit with sufficient headroom, legroom, and access the work surface panel 122. In another aspect, the seat 138 may include a back rest that is adjustable so that the user's seating position may range from a reclined to a prone position. Alternatively, it is contemplated that one or more surfaces of the desk can function as a back rest for the seat 138. The seat 138 may be pivotably adjustable about an axis extending parallel to the depth dimension. The height of the setting apparatus may also be raised and lowered with respect to the height dimension 118. It is further contemplated that in certain aspects the seat 138 may be removably attached to the body 110. According to some aspects, the seat 138 can be a freestanding component that is disconnected from the body 110. The freestanding component can be positioned proximate the work surface so that it can be used by a user seated on the freestanding component. The freestanding component can optionally couple to the body 110 via a bracket (not shown). In further embodiments, the freestanding component can be movable with respect to the body 110 to enable the user to adjust the position of the freestanding component with respect to the body 110. According to further aspects, the desk may comprise a plurality of seats and/or a plurality of work surfaces.

The body 110 may further comprise a stabilizing device 140. The stabilizing device 140 may be a fixture that provides lateral and vertical stability to the body 110 as well as maintains the body in a stationary position. The stabilizing device 140 may comprise ground anchors and/or tethered ropes that may be used to affix the body 110 to another surface or even the ground. The stabilizing device 140 may cooperate with the immobilization component 137 to further limit motion of the desk.

The desk 100 and the body 110 may further comprise at least one storage compartment 146 (optionally, a plurality of storage compartments). The storage compartment 146 can be a space inset within the body 110. For example, the surface panel 112 may define an opening, and at least one secondary inner surface wall 154 may extend therefrom. The at least one secondary inner surface wall 154 may define a storage compartment having an opening 156. The opening 156 can have various shapes, such as a square, a rectangle, a circle, an oval, a trapezoid, a star, a rhombus, an arrow, a thought bubble, or any other suitable shape. In embodiments with a plurality of storage compartments 146, each storage compartment's opening 156 can optionally have a different size and/or shape from other compartments. The storage compartment 146 within the body 110 may be of sufficient size and depth to permit storage of items, such as books, school supplies, craft supplies, and the like. In certain aspects, the storage compartment 146 may also comprise a door 158. In certain aspects, the door 158 of the storage compartment 146 may also be secured. For example, the door 158 may include a lock. In another aspect, the desk can define a shelf.

In another aspect, the body 110 comprises a climbing apparatus 142. The climbing apparatus 142 may be a device that is attached to at least one surface of the body 110. Suitable examples of the climbing apparatus 142 include a rope, a tether, and a plurality of steps, a plurality of holes or pegs, indoor climbing holds, or combinations thereof. In a further aspect, the body can define a plurality of hand holds.

In optional embodiments, opposing inner surfaces of surface panels 116 (i.e. surfaces of transverse surface members 116 opposite transverse surfaces 117) can define an inner volume therebetween. At least one seat 138 and/or work surface panel 122 can be disposed within the inner volume.

It is contemplated that different portions of the body can comprise different features. For example, the body can comprise a vertical portion and a seating portion. The vertical portion can define, for example, a climbing apparatus 142 or a plurality of drawers. The seating portion can comprise a plurality of storage compartments 146 therein. The seating portion can further comprise an attachment for the seat 138 and an attachment for the work surface panel 122. The seating portion can define the covered volume 180 in which the seat 138 and surface panel 122 are disposed. The vertical portion and seating portion can cooperate to define the block letter (e.g., the lowercase 'b' or lowercase 'd'). Optionally, the vertical portion and seating portion are integral to each other. In further embodiments, the vertical portion and seating portion are detachably coupled to each other.

The body can define a main body portion and a dot portion, wherein the main body portion and dot portion are coupled together and cooperate to define a dotted character (e.g., a lowercase 'i' or a lowercase 'j,' as shown). Accordingly, portions of characters that are typically spaced from each other can, in various embodiments, be connected.

The body 110 can comprise a central portion and a plurality of outer portions. Each of the central portion and the outer portions can comprise separate features, such as compartments, shelves, climbing apparatuses, or the like.

The body 110 can define a gap, having a vertical offset, in the character's shape to thereby separate the seat 138 from the work surface. Similarly, referring to the embodiment of FIG. 1, in which the body, the seat, and the work surface panel 122 cooperate to define a capital 'A,' the seat 138 can be spaced and offset from the work surface panel 122. It should be understood that, although these offsets interrupt the shape of the character, a viewer can still recognize the character and, accordingly, embodiments within the scope of the claims are understood to include such offsets.

The work surface panel 122 can be integral to the body 110 so that the body and work surface panel cooperate to define the block letter (e.g., an uppercase 'E' or uppercase 'F'). The seat 138 can be attached to the body 110, for example in a cantilevered fashion, as shown in FIG. 1. Alternatively, the seat 138 can be a freestanding component. The work surface panel 122 can comprise various additional features, such as a compartment 146.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A desk comprising:

a body having:

a generally planar front panel defining a front surface that extends in a vertical dimension and a first horizontal dimension, a generally planar back panel, and at least one transverse surface panel extending transversely between, and attached to, the front panel and the back panel along a transverse dimension that is perpendicular to the front surface, wherein the front panel, in cross section in a plane parallel to the front surface, defines an outline of at least a portion of a block character, wherein the front panel, the back panel, and the at least one transverse surface panel cooperate to define a three-dimensional projection of the outline of said at least a portion of the block character, wherein the block character is an alphabet letter, and wherein the body defines a covered volume; and a generally planar work surface panel attached to the body, wherein an entirety of the generally planar work surface is disposed within the covered volume throughout all positions of the work surface.

2. The desk of claim 1, wherein the body is formed of a structurally rigid material of a sufficient thickness to support a weight of a user.

3. The desk of claim 1, wherein the body is substantially hollow.

4. The desk of claim 1, wherein the generally planar work surface panel extends from the at least one transverse surface panel in the first horizontal dimension.

5. The desk of claim 1, wherein the front panel has first and second side extremities along the first horizontal dimension that define a maximum width of the body, wherein the body has a footprint defined as an extent of the maximum width of the front panel projected along the transverse dimension between the front panel and the back panel, wherein the generally planar work surface panel is disposed within the footprint.

6. The desk of claim 1, wherein the body further comprises at least one mobility device configured to permit selective movement of the desk.

7. The desk of claim 1, further comprising a seat attached to the body proximate the work surface panel so that a user seated in the seat can access the work surface panel.

8. The desk of claim 7, wherein an entirety of the seat is disposed within the covered volume defined by the body.

9. The desk of claim 1, further comprising a climbing apparatus coupled to the body.

10. The desk of claim 1, wherein the body defines handholds configured to enable a user to climb the desk.

11. The desk of claim 1, wherein the body further comprises at least one internal structural support.

12. The desk of claim 2, wherein the structurally rigid material is virgin or recycled material selected from the group consisting of polymer, metal, cellulosic material, and a composite thereof.

13. The desk of claim 2, wherein the structurally rigid material is high density polyethylene (HDPE), fiberglass reinforced plastic, wood, wood composite, or a combination thereof.

14. The desk of claim 1, wherein block character is an alphabet letter.

15. The desk of claim 1, wherein the outline of said at least a portion of the block character is the outline of an entirety of the block character.

16. The desk of claim 15, wherein the block character is the letter A.

17. A desk comprising:

a body having:

a generally planar front panel defining a front surface, a generally planar back panel, and at least one transverse surface panel extending transversely between, and attached to, the front panel and the back panel, wherein the body defines a covered volume; and a generally planar work surface panel attached to the body, wherein an entirety of the generally planar work surface is disposed within the covered volume throughout all positions of the work surface, wherein the front panel and the work surface panel, in cross section in a plane parallel to the front surface, cooperate to define an outline of at least a portion of a block character, wherein the front panel, the back panel, the at least one transverse surface panel, and the work surface panel cooperate to define a three-dimensional projection of the outline of said at least a portion of the block character, wherein the block character is an alphabet letter.

18. The desk of claim 17, wherein the outline of said at least a portion of the block character is the outline of an entirety of the block character.

19. A system comprising:

a plurality of desks, each desk comprising:

a body having:

a generally planar front surface, a generally planar back surface, and at least one transverse surface panel extending transversely between the front surface and the back surface, wherein the front surface defines an outline of at least a portion of a block character, wherein the front surface, the back surface, and the at least one transverse surface cooperate to define a three-dimensional projection of the outline of said at least a portion of the block character, wherein the block character is an alphabet letter, and wherein the body defines a covered volume; and a generally planar work surface panel attached to the body, wherein an entirety of the generally planar work surface is disposed within the covered volume throughout all positions of the work surface.

* * * * *